US010293989B2

(12) United States Patent
Shields

(10) Patent No.: US 10,293,989 B2
(45) Date of Patent: May 21, 2019

(54) CONTAINER FITTING AND CONTAINER UTILIZING SAME

(71) Applicant: Joanna Shields, Phoenix, AZ (US)

(72) Inventor: Joanna Shields, Phoenix, AZ (US)

( * ) Notice: Subject to any disclaimer, the term of this patent is extended or adjusted under 35 U.S.C. 154(b) by 87 days.

(21) Appl. No.: 15/424,350

(22) Filed: Feb. 3, 2017

(65) Prior Publication Data

US 2018/0222640 A1 Aug. 9, 2018

(51) Int. Cl.

| | |
|---|---|
| ***B65D 51/18*** | (2006.01) |
| ***B65D 41/50*** | (2006.01) |
| ***B65D 1/02*** | (2006.01) |
| ***B65D 23/12*** | (2006.01) |
| ***B65D 41/34*** | (2006.01) |
| ***B65D 51/00*** | (2006.01) |

(52) U.S. Cl.

CPC ..... *B65D 41/50* (2013.01); *B65D 1/0246* (2013.01); *B65D 23/12* (2013.01); *B65D 41/34* (2013.01); *B65D 51/002* (2013.01); *B65D 51/185* (2013.01)

(58) Field of Classification Search

CPC ..... B65D 51/18; B65D 51/20; B65D 25/54
USPC ..... 220/257.1, 257.2, 258.3; 215/228, 250
See application file for complete search history.

(56) References Cited

U.S. PATENT DOCUMENTS

| | | | | |
|---|---|---|---|---|
| 5,992,658 | A * | 11/1999 | Berger | B65D 51/20 215/232 |
| 8,672,168 | B2 * | 3/2014 | Triquet | B65D 51/20 215/232 |
| 2009/0120894 | A1 * | 5/2009 | Kario | A47G 19/2272 215/11.1 |
| 2014/0339190 | A1 * | 11/2014 | Lemke | B65D 81/366 215/229 |

* cited by examiner

*Primary Examiner* — King M Chu
(74) *Attorney, Agent, or Firm* — Woods Oviatt Gilman LLP; Dennis B. Danella, Esq.

(57) ABSTRACT

A fitting for affixing to a mouth portion of a receiving container and for receiving a drinking straw comprises a tubular body including a side wall having an inner surface and an outer surface, an open bottom end and a closed top end formed by a top wall having a frangible region therein configured to permit passage of the drinking straw therethrough. A seal layer is coupled to the closed top end and is configured to overlap the frangible region. The fitting may also be mounted onto a container body including a container side wall, an integral container bottom wall and an open top end defined by an open mouth portion. A drinking straw may be releasably coupled to the container body.

23 Claims, 4 Drawing Sheets

CONTAINER FITTING AND CONTAINER UTILIZING SAME

TECHNICAL FIELD

The present invention relates to containers and container fittings; more particularly, to containers configured to receive a container fitting including a frangible region or an open hole adapted to permit passage of a disposable, standard size drinking straw therethrough and a seal layer overlapping the frangible region/open hole; and still more particularly, to a container fitting wherein the frangible region defines a leak-resistant aperture.

BACKGROUND OF THE INVENTION

Container fittings and caps coupled to container mouth openings are known in the art. Typically, containers are closed using a dedicated fitting/cap, with one class of containers holding liquid refreshments such as water, juices, soft drinks and sport/energy drinks. To partake of the liquid within the container, particularly when a secondary container is unavailable, a user needs to remove the fitting/cap and drink directly from the bottle mouth opening. Such direct drinking may be difficult for young children and may cause issues for adults, such as inadvertent spillage or smearing of lipstick. Direct drinking may also pose a danger by causing an unnecessary distraction while driving. Moreover, to ease drink accessibility, a user may decide not to replace the fitting/cap in between sips thereby necessitating that the container remain in an open state. This is most often the case where parents have children drink through a straw which is placed within the container. However, any tipping or inversion of the container may result in spilling, and potentially catastrophic emptying, of the container contents.

As an attempt to alleviate the above shortcomings of conventional caps/fitting, there are a number of alternative container fittings available. However, each of these fittings suffers from one or more significant drawbacks. For instance, one example of a typical fitting includes a threaded fitting with a resealable nozzle. The threaded fitting is sized to fit a standard disposable water bottle. Its nozzle may be opened using fingers or teeth so that liquid may be poured or squirted into the mouth and then closed when not in use to prevent spilling. However, nozzle fittings may be unsuitable for small children as nozzle flow rates may be too fast thereby leading to choking, aspiration or spillage. Also, the resealable nozzle, as known in the art, is comprised of multiple, close-fitting parts which add to the cost of the bottle, and an unnecessary cost if the resealable nozzle is removed to access the bottle's contents.

Accordingly, what is needed in the art is a container fitting which addresses the above recited limitations in the art. What is needed is a container fitting that may receive a disposable straw without requiring removal of the fitting from the container. The fitting may also be leak-resistant while also allowing the container contents to be readily available to a user in a safe, clean and accessible manner.

SUMMARY OF THE INVENTION

Briefly described, a fitting for affixing to a mouth portion of a receiving container and for receiving a drinking straw may comprise a tubular body including a side wall having an inner surface and an outer surface, an open bottom end and a closed top end formed by a top wall having a frangible region therein configured to permit passage of the drinking straw therethrough. A seal layer is coupled to the closed top end and configured to overlap the frangible region. The seal layer may be a peelable layer coupled to the top wall and configured to be removed to thereby uncover the frangible region. Additionally or alternatively, the seal layer may be a puncturable layer coupled to the top wall and may be configured to be punctured by the drinking straw when passing the drinking straw through the frangible region. The seal layer may also be a puncturable layer coupled to the bottom surface of the top wall or a top lip surface of the container wherein the puncturable layer may be punctured by the drinking straw after the drinking straw passes through the frangible region.

A further embodiment of the fitting may include a frangible region with a slit disposed therein. The slit may be configured to define an aperture after the passage of the drinking straw therethrough. The aperture may be substantially leak-resistant. In a further aspect of the present invention, the open bottom end may accommodate a container mouth portion having a diameter of one of approximately 25 mm and the outer surface of the fitting may be knurled. The fitting may be fabricated from a material selected from the group consisting of silicone, polyethylene, high density polyethylene, low density polyethylene, polyethylene terephthalate, polypropylene, a copolyester and combinations thereof, and the aperture is sized to close-fittedly receive a standard size drinking straw where the outer diameter of the standard size drinking straw is approximately 6 mm.

A further embodiment of the fitting may include an open hole formed in the closed top end configured to permit passage of the drinking straw therethrough. A seal layer is coupled to the closed top end and configured to overlap the open hole. The seal layer may be a peelable layer coupled to the top wall and configured to be removed to thereby uncover the open hole. Additionally or alternatively, the seal layer may be a puncturable layer coupled to the top wall and may be configured to be punctured by the drinking straw when passing the drinking straw through the open hole. The seal layer may also be a puncturable layer coupled to the bottom surface of the top wall or a top lip surface of the container wherein the puncturable layer may be punctured by the drinking straw after the drinking straw passes through the open hole.

In a further aspect of the present invention, the puncturable layer may be performated to aid in the puncturability of the layer by the drinking straw.

In a further aspect of the present invention, a container is configured to hold a fluid therein. The container comprises a container body including a container side wall, a container bottom wall and an open top end defined by a container open mouth portion. A fitting is coupled to the container body. The fitting comprises a tubular body including a side wall having an outer surface and an inner surface configured to sealably receive the container open mouth portion, an open bottom end and a closed top end formed by a top wall having a frangible region therein and a seal layer coupled to the closed top end and configured to overlap the frangible region. A drinking straw may be releasably coupled to the container body whereby a portion of the drinking straw is configured to pass through the frangible region of the fitting to enable access to the fluid. The container open mouth portion and fitting inner surface may include corresponding screw threads whereby the fitting may be removed from the container mouth portion by unwinding the screw threads.

BRIEF DESCRIPTION OF THE DRAWINGS

The above-mentioned and other features are advantages of this invention, and the manner of attaining them, will become apparent and be better understood by reference to the following description of the invention in conjunction with the accompanying drawings, wherein.

DESCRIPTION OF THE PREFERRED EMBODIMENTS

Figure 2:
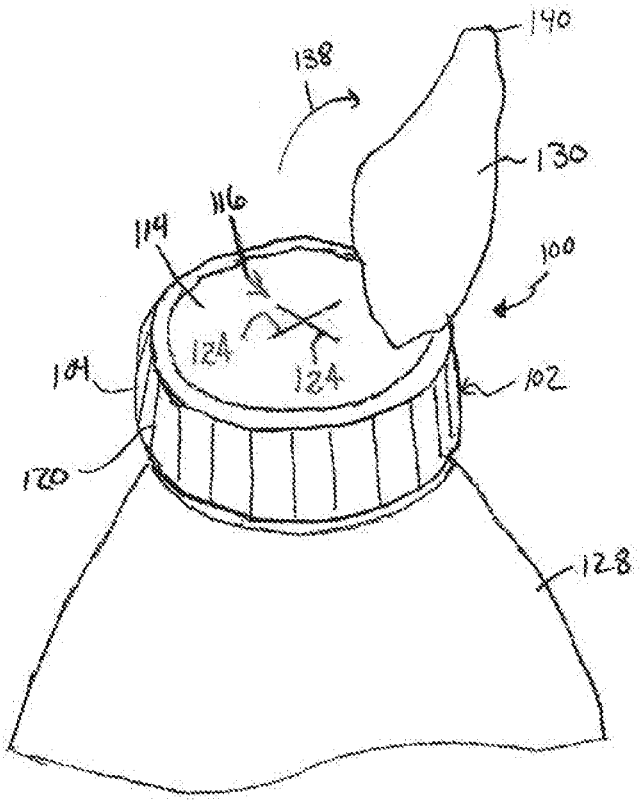
FIG. 2 is a top perspective view of the container fitting shown in FIG. 1 with the peelable seal layer partially removed.
Figure 3:
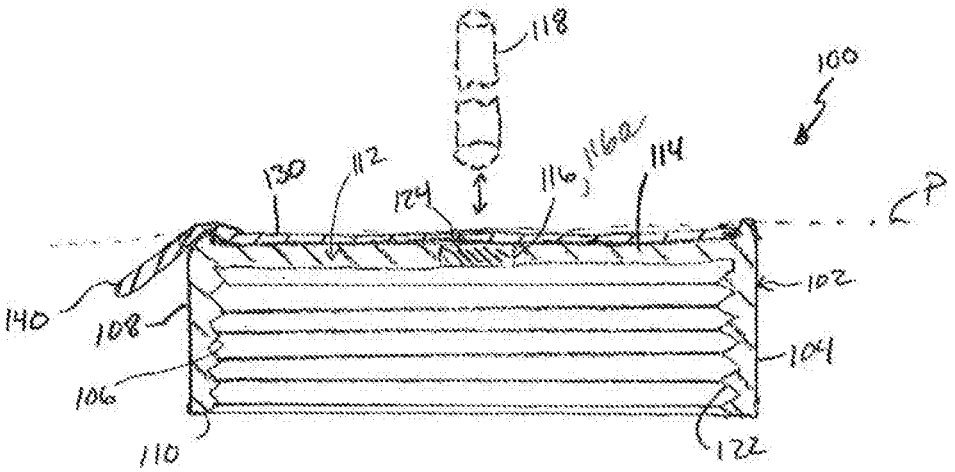
FIG. 3 is a side cross-sectional view of the container fitting shown in FIG. 1 taken along line 3-3.
Figure 4:
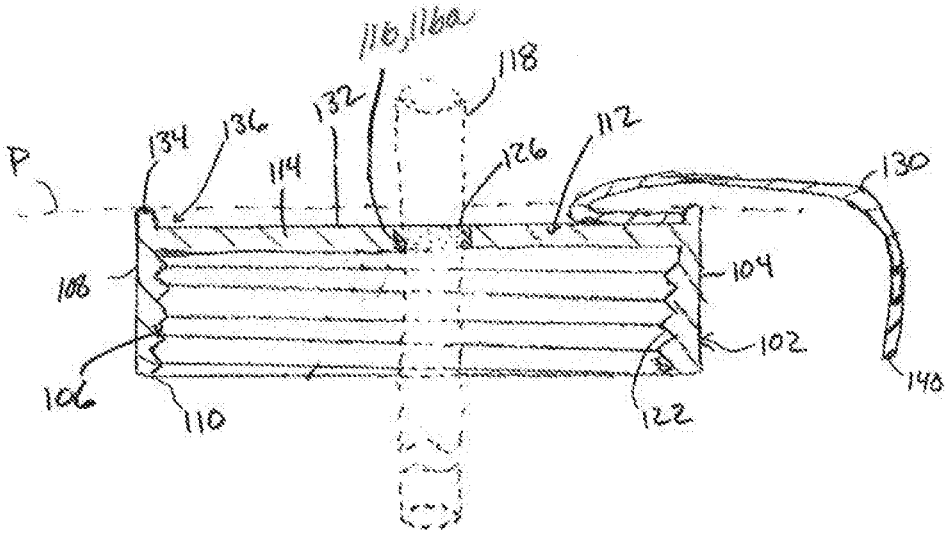
FIG. 4 is a side cross-sectional view of the container fitting shown in FIG. 3 with the peelable seal layer partially removed.

Referring to the drawings in detail, and specifically to FIGS. 1 through 4, container fitting 100 generally comprises a tubular body 102 including a sidewall 104 having an inner surface 106 and an outer surface 108. Body 102 has an open bottom end 110 and a closed top end 112 formed by a top wall 114. Top wall 114 may include a frangible region 116 therein configured to permit passage of a drinking straw 118, as generally indicated in FIG. 4 and as will be discussed in greater detail below. Outer surface 108 may be a smooth surface or may include knurls 120. Knurls 120 may extend along the longitudinal axis of body 102 from top end 112 to bottom end 110, or any intermediate distance therebetween, with successive knurls being in parallel spaced relation to one another.

In one aspect of the invention, inner surface 106 may be smooth surfaced so as to offer a slight interference fit with the mating container mouth. In another aspect of the invention, inner surface 106 may include a series of flexible circular ridges formed axially along the circumferences of the surfaces so as to offer an interference fit with the mating container mouth. In yet another aspect of the invention, inner surface 106 of may include threading 122 configured to cooperate with corresponding threading on the mating container mouth to form a fluid-tight seal.

Frangible region 116 of top wall 114 may include one or more slits 124 configured to provide for an aperture 126 appropriately sized through which a standard size disposable drinking straw 118 may close-fittedly pass from the environment, through top wall 114 and into the interior of container 128. As for example, aperture 126 may be sized to close-fittedly receive a disposable drinking straw having a diameter of approximately 6. mm as distributed by Wal-Mart Stores, Inc. of Bentonville, Ark. Slit 124 may traverse the entire thickness of top wall 114 or may be configured to only partially traverse the thickness, but having such partial traverse sufficiently weakening the integrity of top wall portion 114 so that top wall portion 114 and frangible region 116 are rupturable upon application of a puncturing force from insertion of straw 118 as will be described below.

To that end, top wall 114 may be formed of a rigid yet flexible material such that slit 124 is in a substantially closed position when straw 118 is absent, but also forms around the circumference of straw 118 when the straw is inserted into slit 124 and resides within formed aperture 126. In this manner, container fitting 100 may be substantially leak-resistant. That is, container fitting 100 may resist leaking of fluid within container 128 should container 128 be temporarily tipped or inverted. It should be understood that, should container 128 be tipped or inverted for too long a time period, or should sufficient back pressure be exerted upon the fluid in container 128, some small amount of fluid may leak through aperture 126. However, even in this case, the amount of fluid loss and/or the rate of fluid loss would be substantially less than when container 128 is not outfitted with container fitting 100.

Following removal of straw 118, top wall 114 and slit 124 may resiliently close aperture 126 to substantially reform frangible region 116 as a leak-resistant closure. It should be understood that a completely sealed closure is not required or, in the case of certain embodiments, expected. Rather, aperture 126 may remain partially open but have such opening be small enough so as not to disrupt the intermolecular forces within the fluid within container 128 and thereby promote resistance to leaking.

By way of example, container 128 may be a bottle containing water wherein formed aperture 126 may maintain a sufficiently small opening such that the intermolecular adhesive forces between water molecules are maintained proximate aperture 126. These intermolecular forces may enable a droplet of water to not readily pass through aperture 126. As described above, however, should the water bottle be inverted or tipped for a sufficient amount of time or sufficient pressure be applied to the bottle or water within, the intermolecular adhesion of the water droplet at the aperture may be overcome thereby resulting in leakage of the water. However, as noted above, any such leakage would be significantly less than any leakage through a non-fitted or uncapped mouth opening.

To prevent or minimize unwanted or unintended opening of aperture 126 and to assist in maintaining a fluid-tight seal between fitting 102 and container 128 while container 128 is being stored or shipped, fitting 102 may further include a seal layer 130 coupled to top wall 114. As shown in FIGS. 1 through 4, seal layer 130 may be coupled to the top face 132 of top wall 114. Sidewall 104 may be further configured to include an upwardly extending lip 134 thereby defining a recess 136 adjacent top face 132. Recess 136 may be proportioned to receive seal layer 130 therein such that seal layer 130 resides flush with, or slightly below, the plane P defined by the top edge of lip 134.

Seal layer 130 may be comprised of any suitable seal material commonly used within container sealing applications, including polymeric materials, foil, or laminated combinations thereof. In accordance with an aspect of the present invention, seal layer 130 may be peelably removable as indicated generally by arrow 138 (FIGS. 1 and 2) so as to uncover frangible region 116. To facilitate peeling, seal layer 130 may include a pull tab region 140 configured for convenient gripping by the fingers. Seal layer 130 may be releasably adhered to top face 132 using an appropriate adhesive. In accordance with an aspect of the present invention, the adhesive may be a food-safe resealable adhesive whereby seal layer 130 may be reapplied to top face 132 upon withdrawal of straw 118. In this manner, seal layer 130 may again prevent or inhibit leakage of the remaining fluid within container 128 when the straw is not in use.

Figure 5:
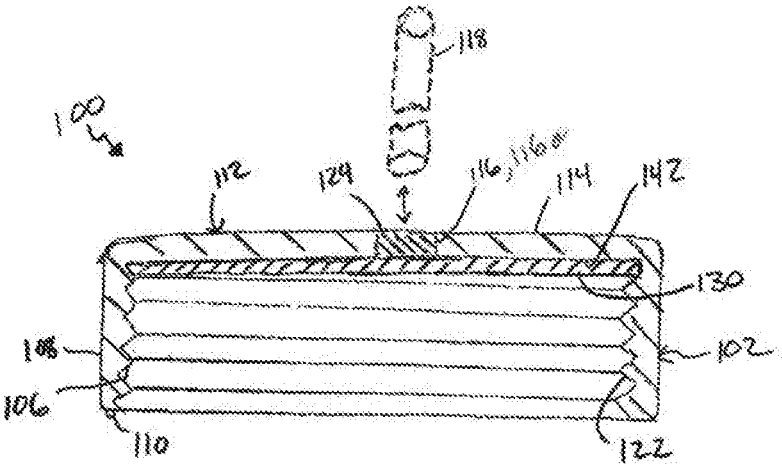
FIG. 5 is a side cross-sectional view of an alternative container fitting in accordance with the invention.

Additionally or alternatively, seal layer 130 may be configured to be a puncturable layer. Thus, as shown in FIG. 3, straw 118 may be directed against seal layer 130 proximate frangible region 116 with sufficient force such that straw 118 may rupture seal layer 130 before passing through slit 124 and formed aperture 126. Alternatively, as shown in FIG. 5, a puncturable seal layer 130 may be coupled to the bottom face 142 of top wall 114. In this manner, straw 118 may pass through slit 124 and formed aperture 126 prior to engaging with and rupturing seal layer 130. It is understood that puncturable seal layer 130 as shown in FIG. 5 may be coupled instead to the top lip surface 129 of container 128.

Figure 1:
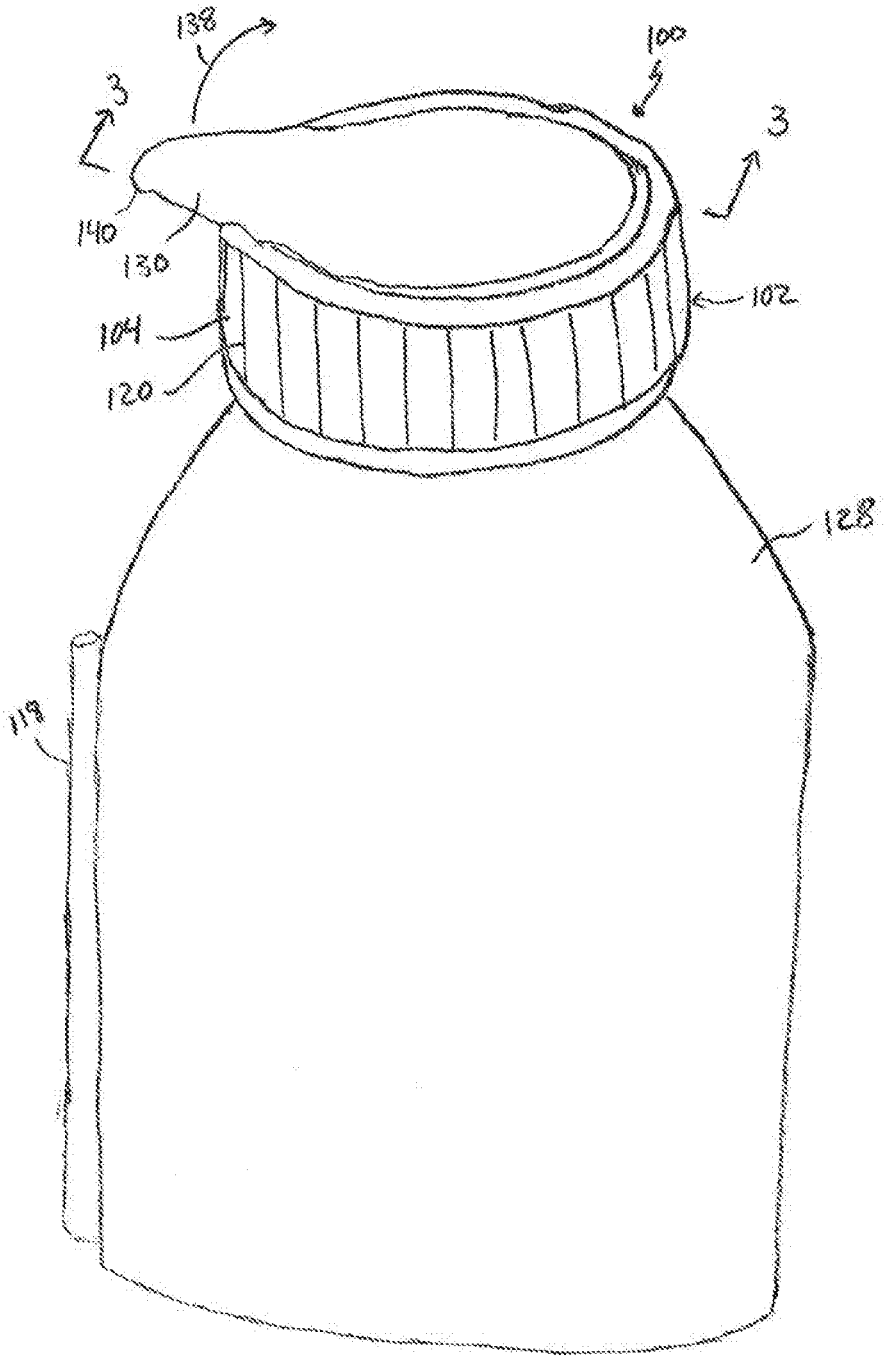
FIG. 1 is a perspective view of an embodiment of a container fitting in accordance with the invention mounted onto a container.

In yet another embodiment, in accordance with an aspect of the invention, straw 118 of a suitable size and construction may be releasably fixed to container 128, as shown in FIG. 1, for convenient use with container fitting 100.

In accordance with a further aspect of the present invention, body 102 of container fitting 100 may be fabricated as a unitary member. While any suitable material may be used to fabricate body 102, examples of such materials include, but are not limited to silicone, polyethylene, high density polyethylene, low density polyethylene, polyethylene terephthalate, polypropylene, a copolyester and combinations thereof. Body 102 of container fitting 100 may further be fabricated from colored materials. In accordance with a further aspect of the present invention, container fitting 100 may be fabricated according to a color scheme wherein an individual fitting may be fabricated from a colored material wherein that color is indicative of the mouth diameter to be received by that fitting.

Figure 2A:
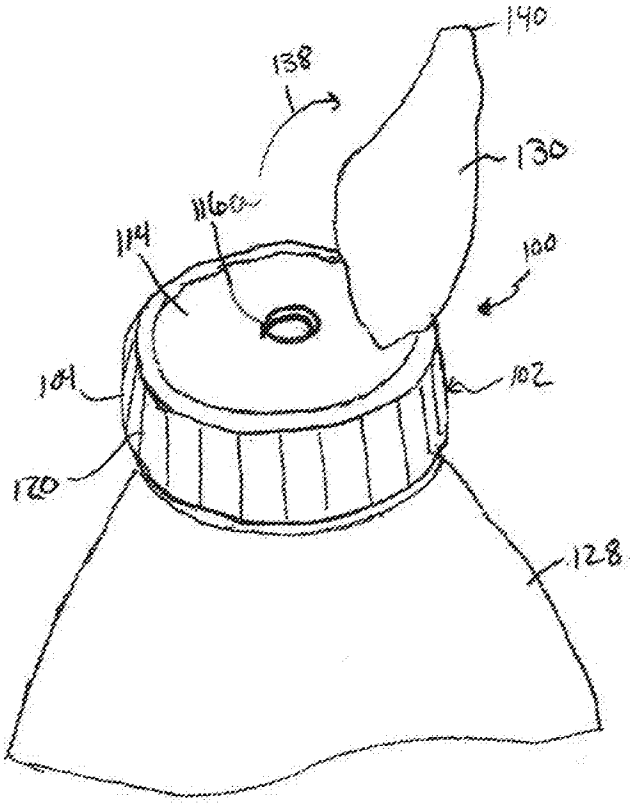
FIG. 2A is a top perspective view of a container fitting having an open orifice rather than a frangible region as shown in FIG. 2.

Alternatively, and in reference to FIG. 2A, rather than a frangible region 116 formed in top wall 114 as described above, an open hole 116*a* may be formed in top wall 114. Open hole 116*a* is sized to allow close-fitting passage of the standard size drinking straw 118. Thus, in this embodiment, while not providing as much of a leak-proof connection around the drinking straw, open hole 116*a* could be used in conjuction with top puncturable seal layer 130 as shown in FIG. 2 or a bottom puncturable seal layer 130 as shown in FIG. 5, whether the bottom puncturable seal adheres to bottom face 142 of top wall 114 or to top lip surface 129 of container 128.

In yet another embodiment, to enhance the puncturablitiy of puncturable seal layer 130, the area of the seal layer in which the straw will puncture may be perforated, preferably only through a portion of the thickness of the seal layer. In that way, the seal layer will remain capable of providing a fluid-tight seal before the seal layer is punctured by the straw. If a bottom puncturable seal is used as in FIG. 5, perforations through the full thickness of the seal layer may be used in conjunction with an added non-perforated top seal 130 as shown in FIG. 2.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fitting for affixing to a mouth portion of a receiving container and for receiving a drinking straw, the fitting comprising:

a) a tubular body including a side wall having an inner surface and an outer surface, an open bottom end and a closed top end formed by a top wall having a frangible region therein configured to permit passage of the drinking straw therethrough; and b) a seal layer coupled to the closed top end and configured to overlap the frangible region, wherein the seal layer is a puncturable layer coupled to the top wall, the puncturable layer configured to be punctured by the drinking straw upon passing the drinking straw through the frangible region.

2. The fitting in accordance with claim 1 wherein the seal layer is a peelable layer coupled to the top wall, the peelable layer configured to be removed to thereby uncover the frangible region.

3. The fitting in accordance with claim 1 wherein the puncturable layer is coupled to a top surface of the top wall.

4. The fitting in accordance with claim 1 wherein the puncturable layer is coupled to a bottom surface of the top wall.

5. The fitting in accordance with claim 1 wherein the frangible region includes a slit disposed therein, the slit configured to define an aperture after the passage of the drinking straw therethrough.

6. The fitting in accordance with claim 5 wherein the aperture is substantially leak-resistant.

7. The fitting in accordance with claim 1 wherein the open bottom end accommodates said container mouth portion having a diameter of approximately 25 mm.

8. The fitting in accordance with claim 1 wherein the outer surface is knurled.

9. The fitting in accordance with claim 1 wherein the fitting is fabricated from a material selected from the group consisting of silicone, polyethylene, high density polyethylene, low density polyethylene, polyethylene terephthalate, polypropylene, a copolyester and combinations thereof.

10. The fitting in accordance with claim 5 wherein the aperture is sized to close-fittedly receive a standard size drinking straw.

11. The fitting in accordance with claim 10 wherein an outer diameter of the standard size drinking straw is approximately 6 mm.

12. The fitting in accordance with claim 1 wherein said frangible region is an open hole.

13. The fitting in accordance with claim 12 wherein the open hole is sized to close-fittedly receive a standard size drinking straw.

14. A container configured to hold a fluid therein, the container comprising:

a) a container body including a container side wall, a container bottom wall and an open top end defined by a container open mouth portion;

b) a fitting coupled to the container body, the fitting comprising:

i) a tubular body including a side wall having an outer surface and an inner surface configured to sealably receive the container open mouth portion, an open bottom end and a closed top end formed by a top wall having a frangible region therein; and ii) a seal layer coupled to the closed top end and configured to overlap the frangible region, wherein the seal layer is a puncturable layer coupled to the top wall, the puncturable layer configured to be punctured by the drinking straw upon passing the drinking straw through the frangible region.

15. The container in accordance with claim 14 further including a drinking straw releasably coupled to the container body, a portion of the drinking straw configured to pass through the frangible region of the fitting to enable access to the fluid.

16. The container in accordance with claim 14 wherein the seal layer is a peelable layer coupled to the top wall, the peelable layer configured to be removed prior to passage of the drinking straw.

17. The container in accordance with claim 14 wherein the puncturable layer is coupled to a top surface of the top wall.

18. The container in accordance with claim 14 wherein the puncturable layer is coupled to a bottom surface of the top wall.

19. The container in accordance with claim 14 wherein the frangible region includes a slit disposed therein, the slit configured to define an aperture after the passage of the drinking straw therethrough.

20. The container in accordance with claim 19 wherein the aperture is substantially leak-resistant.

21. The container in accordance with claim 14 wherein the container open mouth portion and fitting inner surface include corresponding screw threads whereby the fitting may be removed from the container open mouth portion by unwinding the screw threads.

22. A fitting for affixing to a mouth portion of a receiving container and for receiving a drinking straw, the fitting comprising:

a) a tubular body including a side wall having an inner surface and an outer surface, an open bottom end and a closed top end formed by a top wall having a frangible region therein configured to permit passage of the drinking straw therethrough; and b) a seal layer affixed to the closed top end and configured to overlap the frangible region, wherein the tubular body is configured to be selectively re-mountable onto the mating container mouth, and wherein the seal layer is a puncturable layer releasably or permanently affixed to either or both of the top surface and bottom surface of the top wall, the puncturable layer configured to be punctured by the drinking straw upon passing the drinking straw through the frangible region.

23. A fitting for affixing to a mouth portion of a receiving container and for receiving a drinking straw, the fitting comprising:

a) a tubular body including a side wall having an inner surface and an outer surface, an open bottom end and a closed top end formed by a top wall having a frangible region therein configured to permit passage of the drinking straw therethrough; and b) a seal layer affixed to the closed top end and configured to overlap the frangible region, wherein the tubular body is configured to be selectively re-mountable onto the mating container mouth, and wherein said inner surface of said side wall of said tubular body is threaded, of a smooth surface or includes flexible circular ridges formed axially along a circumference of said inner surface for remounting said tubular body to said mating container mouth.

* * * * *